US011380343B2

(12) United States Patent
Johnston et al.

(10) Patent No.: US 11,380,343 B2
(45) Date of Patent: Jul. 5, 2022

(54) SYSTEMS AND METHODS FOR PROCESSING HIGH FREQUENCY AUDIO SIGNAL

(71) Applicant: IMMERSION NETWORKS, INC., Renton, WA (US)

(72) Inventors: James David Johnston, Redmond, WA (US); King Wei Hor, Redmond, WA (US)

(73) Assignee: IMMERSION NETWORKS, INC., Renton, WA (US)

( * ) Notice: Subject to any disclaimer, the term of this patent is extended or adjusted under 35 U.S.C. 154(b) by 60 days.

(21) Appl. No.: 16/568,858

(22) Filed: Sep. 12, 2019

(65) Prior Publication Data

US 2021/0082448 A1 Mar. 18, 2021

(51) Int. Cl.
*G10L 19/26* (2013.01)

(52) U.S. Cl.
CPC ..... *G10L 19/265* (2013.01)

(58) Field of Classification Search
CPC ... G10L 21/038; G10L 19/0204; G10L 19/24; G10L 19/12; G10L 19/26; G10L 19/06; G10L 19/0208; G10L 19/265; G10L 19/04; G10L 19/08; G10L 19/22; G10L 19/00; G10L 19/20; G10L 21/0232; G10L 25/90;

(Continued)

(56) References Cited

U.S. PATENT DOCUMENTS 5,841,537 A 11/1998 Doty
5,845,244 A 12/1998 Proust
5,974,380 A 10/1999 Smyth (Continued)

FOREIGN PATENT DOCUMENTS

CA 1149201 7/1983
EP 2239539 10/2010

(Continued)

OTHER PUBLICATIONS

Dietrich, "Perfomrance and Implementation of a Robust ADPCM Algorithm for Wideband Speech Coding with 64 kbit/s", Proc. International Zurich Seminar Digital Communicat., Jan. 1, 1984, pp. 15-21.

(Continued)

*Primary Examiner* — Bhavesh M Mehta
(74) *Attorney, Agent, or Firm* — Jackson Walker LLP; Christopher J. Rourk

(57) ABSTRACT

A method for encoding an audio signal, comprising using one or more algorithms operating on a processor to filter the audio signal into two output signals, wherein each output signal has a sampling rate that is equal to a sampling rate of the audio signal, and wherein one of the output signals includes high frequency data. Using one or more algorithms operating on the processor to window the high frequency data by selecting a set of the high frequency data. Using one or more algorithms operating on the processor to determine a set of linear predictive coding (LPC) coefficients for the windowed data. Using one or more algorithms operating on the processor to generate energy scale values for the windowed data. Using one or more algorithms operating on the processor to generate an encoded high frequency bitstream.

17 Claims, 6 Drawing Sheets

(58) Field of Classification Search
CPC ..... G10L 19/07; G10L 19/09; G10L 19/16; G10L 21/0224; G10L 19/02
See application file for complete search history.

(56) References Cited

U.S. PATENT DOCUMENTS

| | | | | |
|---|---|---|---|---|
| 5,978,762 | A | 11/1999 | Smyth | |
| 6,480,152 | B2 | 11/2002 | Lin et al. | |
| 6,493,664 | B1 | 12/2002 | Udaya Bhaskar et al. | |
| 6,975,254 | B1 | 12/2005 | Sperschneider et al. | |
| 7,394,410 | B1 | 7/2008 | Wegener | |
| 8,140,324 | B2 * | 3/2012 | Vos | G10L 19/038 704/225 |
| 9,170,124 | B2 | 10/2015 | Keene et al. | |
| 10,339,947 | B2 | 7/2019 | Johnston et al. | |
| 10,354,667 | B2 | 7/2019 | Johnston et al. | |
| 10,354,668 | B2 | 7/2019 | Johnston et al. | |
| 10,354,669 | B2 | 7/2019 | Johnston et al. | |
| 2005/0052294 | A1 | 3/2005 | Liang | H04N 19/52 341/63 |
| 2005/0096900 | A1 * | 5/2005 | Bossemeyer | G10L 17/02 704/219 |
| 2007/0088541 | A1 | 4/2007 | Vos | |
| 2007/0088558 | A1 | 4/2007 | Vos | |
| 2007/0118362 | A1 | 5/2007 | Kondo | |
| 2007/0146185 | A1 | 6/2007 | Kang | H03H 17/0416 341/143 |
| 2008/0027711 | A1 | 1/2008 | Rajendran et al. | |
| 2008/0126086 | A1 | 5/2008 | Vos | |
| 2009/0240491 | A1 | 9/2009 | Reznik | G10L 19/24 704/219 |
| 2009/0254783 | A1 | 10/2009 | Hirschfeld et al. | |
| 2909/6254783 | | 10/2009 | Hirschfeld et al. | |
| 2009/0319264 | A1 * | 12/2009 | Yoshida | G10L 19/005 704/230 |
| 2009/0326851 | A1 | 12/2009 | Tanenhaus | |
| 2010/0114329 | A1 | 5/2010 | Casler et al. | |
| 2011/0200125 | A1 | 8/2011 | Multrus | H03M 7/3088 375/259 |
| 2011/0224995 | A1 | 9/2011 | Kovesi et al. | |
| 2012/0065965 | A1 | 3/2012 | Choo et al. | |
| 2014/0229186 | A1 | 8/2014 | Mehrotra et al. | |
| 2014/0270743 | A1 | 9/2014 | Webb et al. | |
| 2015/0371653 | A1 | 12/2015 | Pilli | |
| 2016/0047675 | A1 | 2/2016 | Tanenhaus et al. | |
| 2017/0241783 | A1 | 8/2017 | Askarpour et al. | |
| 2017/0330572 | A1 | 11/2017 | Johnston | |
| 2017/0330574 | A1 | 11/2017 | Johnston | |
| 2017/0330575 | A1 | 11/2017 | Johnston | |
| 2017/0330577 | A1 | 11/2017 | Johnston | |
| 2020/0126410 | A1 * | 4/2020 | Voncken | G08G 1/0145 |

FOREIGN PATENT DOCUMENTS

| | | |
|---|---|---|
| WO | 94/16504 | 7/1994 |
| WO | 2009/086919 | 7/2009 |
| WO | 2016/016124 | 2/2016 |

OTHER PUBLICATIONS

Crochiere, "Digital Signal Processor: Sub-band coding", Bell System Technical Journal, AT and T, Short Hills, NY, US, vol. 7, No. 7, Sep. 1, 1981, pp. 1633-1653.

Ramamoorthy, et al., "Enhancement of ADPCM Speech Coding with Backward-Adaptive Algorithms for Postfiltering and Noise Feedback", ACM Transactions on Computer Systems (TOCS), Association for Computing Machinery, Inc. US, vol. 6, No. 2, Feb. 1, 1988, pp. 364-382.

Atal, et al., "Adaptive Predictive Coding of Speech Signals" Bell System Technical Journal, AT and T, Short Hills, NY, US, vol. 49, No. 8, Oct. 1, 1970, pp. 1973-1986.

Holters, et al., "Delay-Free Lossy Audio Coding Using Shelving Pre and Post-Filters", Acoustics, Speech and Signal Processing, 2008, ICASSP 2008, IEEE International Conference on IEEE, Piscataway, NJ, USA, Mar. 31, 2008, pp. 209-212.

Jayant, "Adaptive Post-Filtering of ADPCM Speech", Bell System Technical Journal, AT and T, Short Hills, NY, US, vol. 60, No. 5, May 1, 1981, pp. 707-717.

"7 kHz Audio-Coding Within 64 KBIT/S", ITU-T Standard, International Telecommunication Union, Geneva, CH, No. G.722, Nov. 25, 1988, pp. 1-75.

Dubnowski et al (Microprocessor Log PCM/ADPMC code converter, IEEE Transactions on Communications, vol. COM-26, No. 5, May 1978, pp. 660-664).

Kroon et al, "A Class of Analysis-by-Synthesis Predictive Coders", 1988, pp. 353-363, IEEE Journal on Selected Areas in communications, vol. 6, No. 2.

3GPP2C.S0014-0V1 .0, Enhanced Variable Rate Codec (EVRC), 36 pages.

Office Action dated Feb. 27, 2018 for U.S. Appl. No. 15/151,109, 56 pgs.

Final Office Action dated Sep. 7, 2018 for U.S. Appl. No. 15/151,109, 122 pgs.

Office Action dated Feb. 28, 2018 for U.S. Appl. No. 15/151,200, 40 pgs.

Final Office Action dated Sep. 7, 2018 for U.S. Appl. No. 15/151,200, 104 pgs.

Office Action dated Feb. 26, 2018 for U.S. Appl. No. 15/151,211, 53 pgs.

Final Office Action dated Sep. 10, 2018 for U.S. Appl. No. 15/151,211, 100 pgs.

Notification Concerning Transmittal of International Preliminary Report on Patentability dated Nov. 22, 2018 from the International Bureau of WIPO containing the Written Opinion of the International Searching Authority—EPO—for International Application No. PCT/US2017/031735, 21 pages.

Office Action dated Dec. 18, 2018 issued by the European Patent Office for EP17724255.9, 3 pages.

3GPP2C.S0014-0V1.0, Enhanced Variable Rate Codec (EVRC), 1995-2000, 139 pages.

3GPP2C.S0014-0V1.0, Enhanced Variable Rate Codec (EVRC), 139 pages.

Notification of Transmittal of the International Preliminary Report on Patentability dated Sep. 16, 2019 from the International Preliminary Examining Authority—The United States Patent & Trademark Office—for International Application No. PCT/US2018/053086, 17 pages.

Notification of Transmittal of the International Search Report and Written Opinion from the International Searching Authority—The European Patent Office—for International Application No. PCT/US2018/053086, dated Jan. 4, 2019, 15 pages.

Notification of Transmittal of the International Search Report and the Written Opinion of the International Searching Authority—Russia—dated Nov. 19, 2020 for co-pending International Application No. PCT/US2020/050529, 8 pages.

* cited by examiner

200

SYSTEMS AND METHODS FOR PROCESSING HIGH FREQUENCY AUDIO SIGNAL

TECHNICAL FIELD

The present disclosure relates generally to audio signal processing, and in particular, to systems, methods and apparatuses to encode and decode high frequency audio signals.

BACKGROUND

Audio coding systems use different methods for coding audio signal. Given perceptual constraints, a high frequency component of an audio signal can be coded differently than the lower frequency component of that audio signal. Applying coding methods known in the art on the high frequency component may result in the reduction of the coded bitrate while maintaining a high perceptual audio quality. The need for applications used for high frequency audio data coding to provide a temporally accurate, frequency shaped reconstruction of the original high frequency audio data exists.

SUMMARY OF THE INVENTION

A method for encoding an audio signal is disclosed that includes using one or more algorithms operating on a processor to filter the audio signal into two output signals, wherein each output signal has a sampling rate that is equal to a sampling rate of the audio signal, and wherein one of the output signals includes high frequency data. One or more algorithms operating on the processor are then used to window the high frequency data by selecting a set of the high frequency data windowing the selected high frequency data in time domain. One or more algorithms operating on the processor are then used to determine a set of linear predictive coding (LPC) coefficients for the windowed data. One or more algorithms operating on the processor are then used to generate energy scale values for the windowed data. One or more algorithms operating on the processor are then used to generate an encoded high frequency bitstream.

Other systems, methods, features, and advantages of the present disclosure will be or become apparent to one with skill in the art upon examination of the following drawings and detailed description. It is intended that all such additional systems, methods, features, and advantages be included within this description, be within the scope of the present disclosure, and be protected by the accompanying claims.

BRIEF DESCRIPTION OF DRAWINGS

Aspects of the disclosure can be better understood with reference to the following drawings. The components in the drawings may be to scale, but emphasis is placed upon clearly illustrating the principles of the present disclosure. Moreover, in the drawings, like reference numerals designate corresponding parts throughout the several views, and in which.

DETAILED DESCRIPTION

Figure 1:
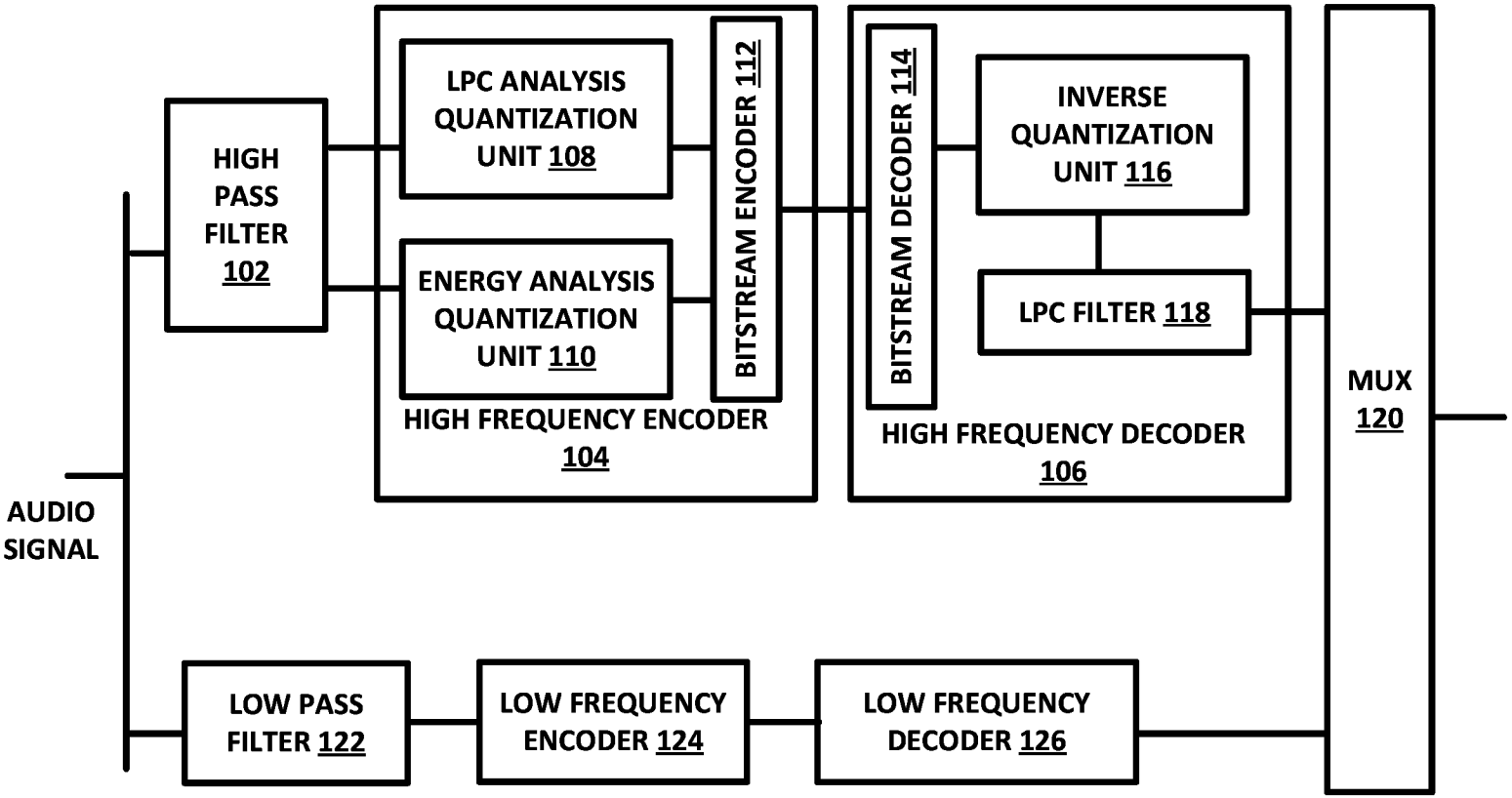
FIG. 1 is a block diagram depicting a codec for encoding and decoding audio signals, in accordance with an example embodiment of the present disclosure.

In the description that follows, like parts are marked throughout the specification and drawings with the same reference numerals. The drawing figures may be to scale, and certain components can be shown in generalized or schematic form and identified by commercial designations in the interest of clarity and conciseness.

FIG. 1 is a block diagram 100 depicting a codec for encoding and decoding audio signals, in accordance with an example embodiment of the present disclosure. Block diagram 100 includes high pass filter 102, high frequency encoder 104, high frequency decoder 106, LPC analysis quantization unit 108, energy analysis quantization unit 110, bitstream encoder 112, bitstream decoder 114, inverse quantization unit 116, LPC filter 118, multiplexer 120, low pass filter 122, low frequency encoder 124 and low frequency decoder 126, each of which can be implemented in hardware or a suitable combination of hardware and software, and which can be a processor configured to operate under control of one or more algorithms.

High frequency audio data is provided to high pass filter 102 and low pass filter 122 using a 2-band non-decimated signal splitter or in other suitable manners. In this example embodiment, the audio signal can be processed by high-pass filter 102 and low-pass filter 122 to generate two intermediate output signals, where the sampling rates of the two intermediate output signals are not decimated and can remain the same as the sampling rate of the audio signal. High pass filter 102 is coupled to LPC quantization analysis unit 108 and energy analysis quantization unit 110 of high frequency encoder 104, and low pass filter 122 is coupled to low frequency encoder 124. High frequency encoder 104 can also include bitstream encoder 112. High frequency decoder 106 is coupled to high frequency encoder 104, where high frequency decoder 106 further includes inverse quantization unit 116 and LPC filter 118 (which can be implemented as an all-pole filter or in other suitable embodiments which can provide a linear predictive coding function). High frequency decoder 106 can also include bitstream decoder 114. Bitstream decoder 114 is coupled to bitstream encoder 112 of high frequency encoder 104 and inverse quantization unit 116. LPC filter 118 is coupled to inverse quantization unit 116 and multiplexer 120.

Low frequency encoder 124 can use low-pass filter 122, which can have the same transition frequency as high-pass filter 102. Different transition frequencies can also or alternatively be used for high pass filter 102 and low pass filter 122. Likewise, other suitable 2-band split techniques can also or alternatively be used to obtain high frequency audio data and low frequency audio data for analysis. Standard audio encoders can be used below the transition (or crossover) frequency chosen for the switchover to the high frequency coder. The encoded high frequency audio data and encoded low frequency audio data can be combined by multiplexer 120, which is coupled to LPC filter 118 of high frequency decoder 106 and low frequency decoder 126, a transmitter for transmission or other suitable devices.

Above a high frequency threshold, a linear predictive coding (LPC) model is determined, such as using a linear predictive coding method or in other suitable embodiments. This LPC model, as an all-zero flattening filter, can be used to create an open-loop (forward noise shaping without feedback) residual. This residual is characterized by an overall "noise-like" envelope that has a spectrum that is similar to the original high frequency audio signal. LPC coefficients are obtained by LPC analysis quantization unit 108, and the energy scale values of the noise-like envelope are obtained by energy analysis quantization unit 110. The LPC coefficients and the energy scale values are encoded by bitstream encoder 112 for transmission to high frequency decoder 106. The temporal and noise-like characteristics of the audio signal can be reconstructed by high frequency decoder 106, and the LPC coefficients and energy scale values can be passed through LPC filter 118. The values after LPC filter 118 are added back to the low frequency signal as encoded by other methods below the transition frequency.

Figure 2:
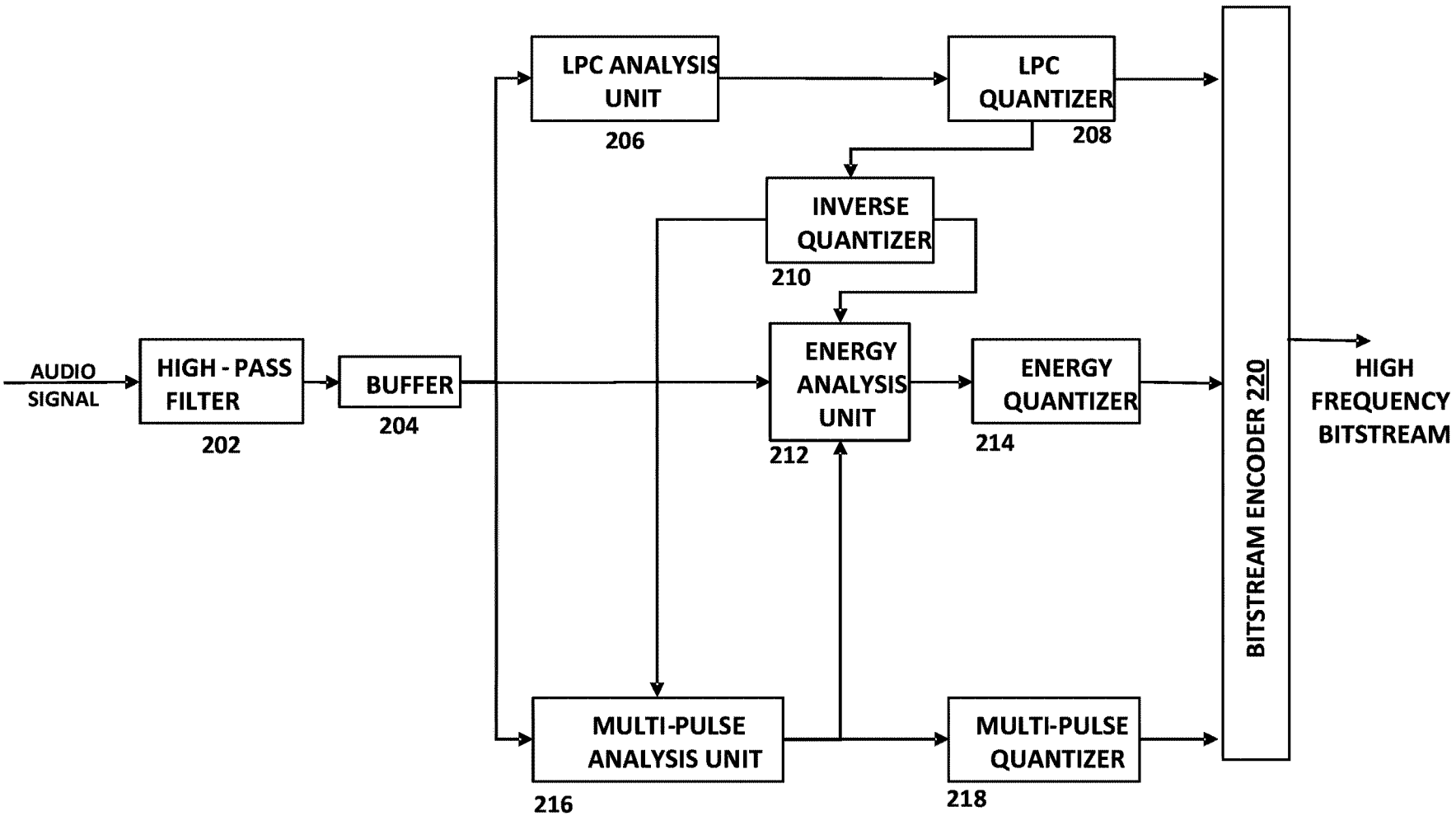
FIG. 2 is a block diagram depicting a high frequency encoder for encoding high frequency audio signal, in accordance with an example embodiment of the present disclosure.

FIG. 2 is a block diagram 200 of a high frequency encoder for encoding high frequency data of audio signals, in accordance with an example embodiment of the present disclosure. Block diagram 200 includes high pass filter 202, buffer 204, LPC analysis unit 206, LPC quantizer 208, inverse quantizer 210, energy analysis unit 212, energy quantizer 214, multi-pulse analysis unit 216, multi-pulse quantizer 218 and bitstream encoder 220, each of which can be implemented in hardware or a suitable combination of hardware and software, and which can be a processor configured to operate under control of one or more algorithms.

An LPC model is calculated based on the spectrum above and only above the crossover frequency. The high frequency audio data is filtered by high pass filter 202, buffered at buffer 204 and separated into blocks of data, for example in blocks of 1024 samples. Buffer 204 is coupled to LPC analysis unit 206, energy analysis unit 212 and multi-pulse analysis unit 216. The blocks of data can be overlapped by a step size, for example a step size of 128 samples or other suitable step sizes. LPC analysis unit 206 is coupled to LPC quantizer 208 and processes a first block of samples, and then processes a second block of samples, which can be shifted by a step size or other suitable values. Each block of data/samples can be windowed, for example using a minimum phase window or Hann window to produce a windowed signal or in other suitable manners.

LPC coefficients can be computed by applying an autocorrelation of the windowed signal. Other techniques may be used such that the result is based on the autocorrelation of a modified frequency spectrum. For example, the windowed signal can be processed by a spectrum analysis method. The frequency spectrum of the windowed signal can be modified so that the low frequency components are extended from the high frequency components, or in other suitable manners. The spectrum analysis is later encoded for transmission. Using the results of the (possibly modified) autocorrelation, the LPC coefficients can be computed by using the Levinson-Durbin recursion algorithm, or in other suitable manners. The Levinson-Durbin algorithm is a recursive (or iterative) method that calculates an LPC coefficient with each pass. The number of LPC coefficients can be fixed or variable. The number of coefficients can be determined by examining the residual value in the Levinson-Durbin algorithm during each iteration, or in other suitable manners. In one example embodiment, if the residual at a specific iteration is less than a threshold value, then the algorithm or other suitable function exits the recursive process with the coefficients computed up to the current iteration.

The LPC coefficients obtained by LPC analysis unit 206 are quantized by LPC quantizer 208, which is coupled to inverse quantizer 210 and bitstream encoder 220, and the current quantized values are compared with the previous LPC coefficients using a similarity or distance measure. If the measure is greater than a threshold value, such that the current LPC coefficients are too dissimilar to the previous LPC coefficients, the latest LPC coefficients can be transmitted to reconstruct the sample set. Otherwise, the previous LPC coefficients can be used, or other suitable processes can also or alternatively be used. The LPC coefficients are quantized by LPC quantizer 208 for transmission. To reduce the bitrate during the transmission, Huffman coding or other suitable compression processes can be used by bitstream encoder 220.

Multi-pulse analysis unit 216, which can perform multiple peak analysis or other suitable analysis, is coupled to inverse quantizer 210, energy analysis unit 212 and multi-pulse quantizer 212, and can process the blocks of samples, such as in blocks of 1024 samples to identify multiple pulses or peaks in the data, or in other suitable manners. The LPC coefficients from inverse quantizer 210 can be used by multi-pulse analysis unit 216 to perform an all-zero filter on the blocks of samples. An analytic signal can be computed using a Hilbert transform on the filtered block. The analytic signal can be used to find peak values by examining the highest values, the values having the highest magnitude or other suitable data. These highest values are removed using an analytic signal of an impulse response for the high-pass filter. The next highest values can be found after removing the highest values. The peak values generated by multi-pulse analysis unit 216 are quantized by multi-pulse quantizer 218 and encoded by bitstream encoder 220 for transmission. The indices (position and amplitude) of the peak values are also encoded by bitstream encoder 220 for transmission with the quantized peak values. To reduce the bitrate during the transmission, different types of coding methods may be used, such as Huffman coding. The signal remaining after the peaks are removed may be analyzed for energy content. The energy content is also encoded for transmission.

Energy analysis unit 212 is coupled to inverse quantizer 210 and energy quantizer 214, and constructs a signal by using the LPC coefficients from inverse quantizer 210 to filter values that include high frequency noise, which can be generated using standard techniques for generating white noise and high-pass filtering. In one example embodiment, the techniques can include using a pseudo-random number generator, capturing the values from a random source that has a uniform distribution or other suitable processes can also or alternatively be used. The blocks of samples after peak values are removed by multi-pulse analysis unit 216 can also be processed by the energy analysis unit 212 to generate constructed signal. The energy analysis unit 212 compares the energy of the constructed signal to the original high frequency audio signal in a block of data, for example 128 samples. The energy analysis unit 212 also generates energy values, which can be computed by summing the squared amplitude of the block of signal. An energy scale value is computed by taking the ratio of the energy values. Similar to using a measure to decide on keeping latest LPC coefficients, the energy scale value of the current block of sample is compared with the prior scale value. If the difference in values is above a certain threshold, the latest scale value will be used for transmission. Otherwise, the prior scale value is used. The energy scale values are quantized by energy quantizer 214 for transmission. To reduce the bitrate during the transmission, Huffman coding or other suitable coding processes can be used by bitstream encoder 220.

Figure 3:
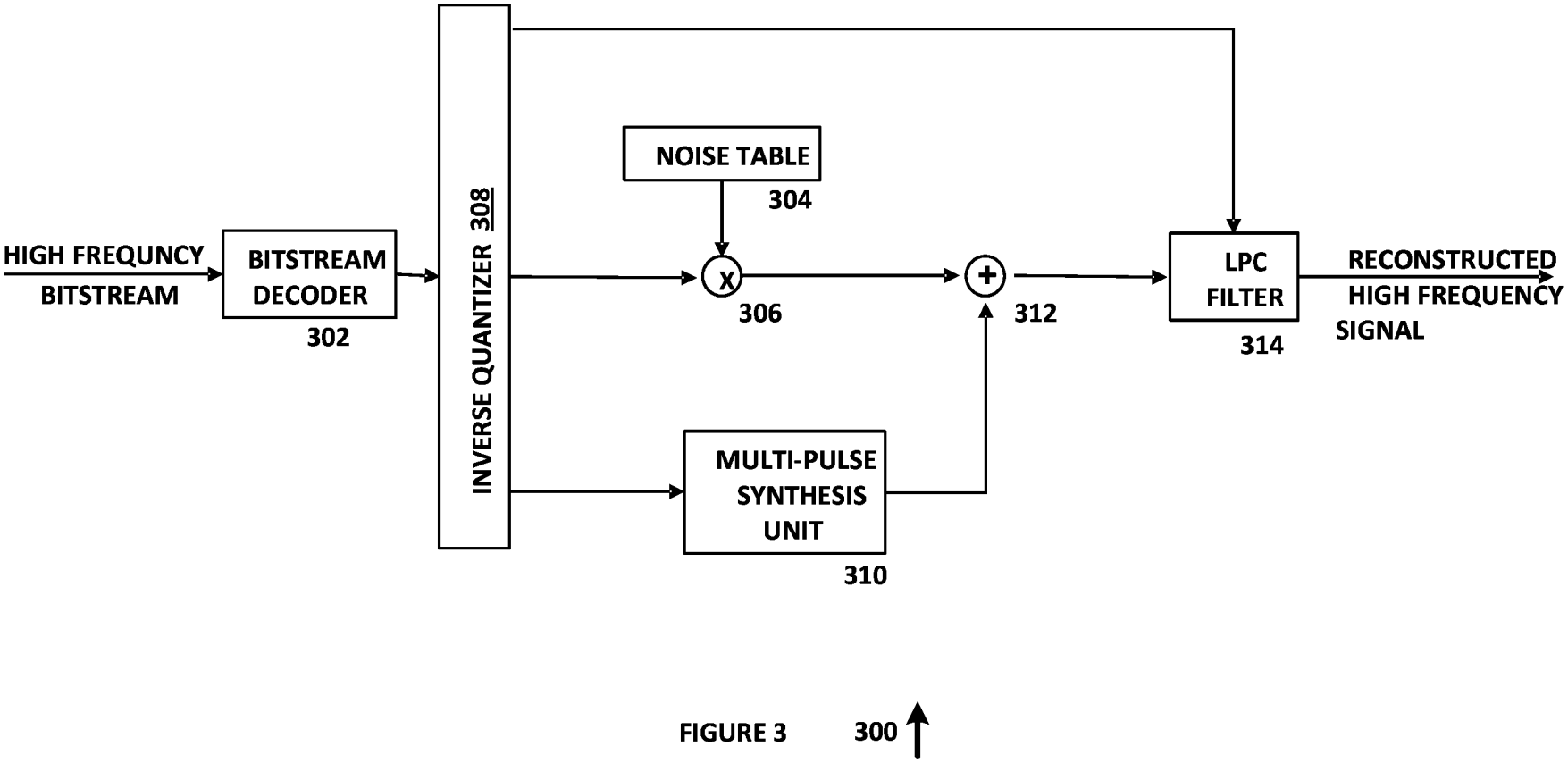
FIG. 3 is a block diagram depicting a high frequency decoder for decoding high frequency audio signal, in accordance with an example embodiment of the present disclosure.

FIG. 3 depicts a high frequency decoder 300, according to an example embodiment of the present disclosure. High frequency decoder 300 includes bitstream decoder 302, noise table 304, multiplier 306, inverse quantizer 308, multi-pulse synthesis unit 310, adder 312 and LPC filter 314, each of which can be implemented in hardware or a suitable combination of hardware and software, and which can be a processor configured to operate under control of one or more algorithms.

High frequency decoder 300 receives and decodes a high frequency bitstream using bitstream decoder 302, which can use Huffman decoding or other suitable decoding processes. Bitstream decoder 302 is coupled to inverse quantizer 308. The high frequency bitstream is decoded into a signal that can include quantized LPC coefficients, quantized energy scale values, quantized peak values and indices corresponding to the quantized peak values indices and other suitable data.

Inverse quantizer 308 is coupled to and outputs decoded data to LPC filter 314, multiplier 306 and multi-pulse synthesis unit 310, and performs inverse quantization on the quantized values, e.g. quantized LPC coefficients, quantized energy scale values, and quantized peak values. The quantized LPC coefficients are inverse quantized to LPC coefficients and the LPC coefficients are sent to LPC filter 314. The quantized energy scale values are inverse quantized to energy scale values. An energy scale value can be multiplied to a high frequency noise value for a specific noise block length, such as 128 samples or other suitable noise block lengths. Noise table 304 is coupled to multiplier 306 and can be used to generate a high frequency noise value, or other suitable processes can also or alternatively be used. A windowed noise signal corresponding to the energy transmitted is created by multiplier 306. An interpolation method, such as to use overlapping sample windows between a previous sample block, a current sample block and a next sample block or other suitable processes, can be used to smoothly transition to sample blocks with different energy values. If quantized peak values are available, the quantized peak values can be inverse quantized by inverse quantizer 308. Impulse response (for the high-pass filter) values of the peak values can be obtained from multi-pulse synthesis unit 310 and added to the block of data by adder 312. LPC filter is coupled to adder 312, which is also coupled to multi-pulse synthesis unit 310. The LPC coefficients can be used by an LPC filter 314 to perform an all-pole filter on the block of data. A reconstructed high frequency signal is generated for the block of data.

Figure 4:
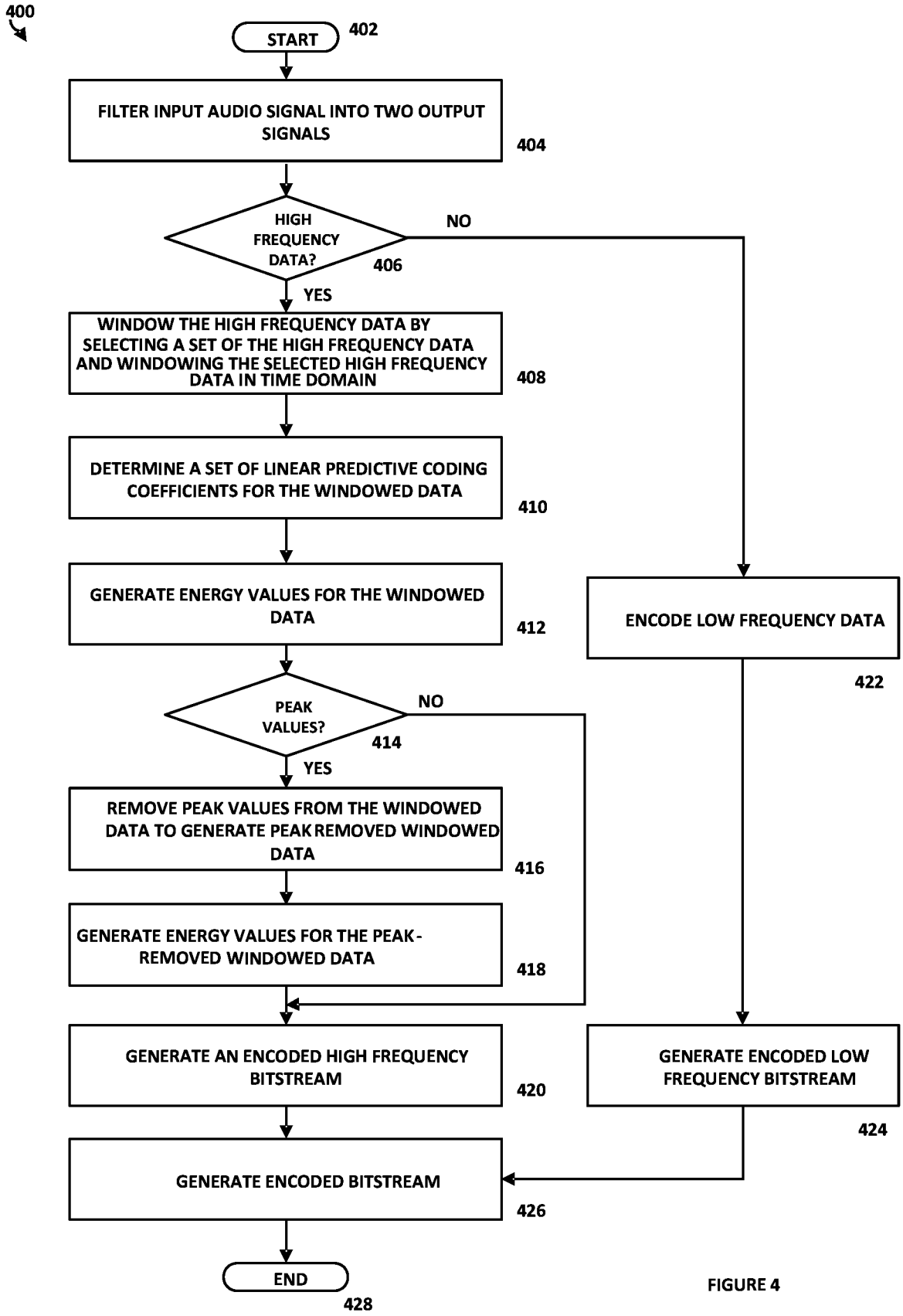
FIG. 4 is an algorithm flow chart depicting a method for encoding an audio signal, in accordance with an example embodiment of the present disclosure.

FIG. 4 is a diagram of an algorithm 400 for encoding an audio signal, in accordance with an example embodiment of the present disclosure. Algorithm 400 can be implemented in hardware or a suitable combination of hardware and software, and can be one or more algorithms operating on a processing platform.

Algorithm 400 is initiated at 402, such as upon device activation, activation of an application using the encoding method or other suitable events. Upon initiation, the algorithm proceeds to 404, where an input audio signal is filtered into two output signals. In one example embodiment, each output signal can have a sampling rate that is equal to a sampling rate of the input audio signal, or other suitable processes can also or alternatively be used. The algorithm then proceeds to 406.

At 406, it is determined whether one of the output signals includes high frequency data. If it is determined that the one of the output signals includes high frequency data, the algorithm proceeds to 408. If it is determined that one of the output signals does not include high frequency data, e.g. where it includes low frequency data, the algorithm proceeds to 422.

At 422, low frequency data is encoded. In one example embodiment, a low frequency data encoding process can be used to generate blocks of low frequency data that are stored to a data buffer, or other suitable processes can also or alternatively be used. The algorithm then proceeds to 424.

At 424, a bitstream of encoded low frequency data is generated. In one example embodiment, buffered low frequency data can be compiled into a bit stream, such as by serial read-out, compression encoding or in other suitable manners. The algorithm then proceeds to 426, where the encoded low frequency bitstream is combined with an encoded high frequency bitstream.

At 408, the high frequency data can be windowed by selecting a set of the high frequency data and windowing the selected high frequency data in time domain. In one example embodiment, the window can be selected based on a fixed number of bits, a variable number of bits or in other suitable manners. The algorithm then proceeds to 410.

At 410, a set of linear predictive coding coefficients is determined for the windowed data. In one example embodiment, the linear predictive coding coefficients can include log area ratios (LAR), line spectral pairs (LSP) decomposition and reflection coefficients or other suitable coefficients. The algorithm then proceeds to 412.

At 412, energy values are generated for the windowed data. In one example embodiment, the energy values can be determined by performing a fast Fourier Transform and then by multiplying each frequency bin of the output with its complex conjugate, or in other suitable manners. The algorithm then proceeds to 414.

At 414, it is determined whether the windowed data contains peak values. In one example embodiment, a peak value can be determined by comparing each sample value to a maximum sample value and a minimum sample value over the sample window, and determining whether the sample value is the maximum sample value, whether the sample value exceeds the minimum sample value by a predetermined amount, whether the sample value exceeds a root mean square sample value by a predetermined amount, or in other suitable manners. If it is determined that the windowed data contains one or more peak data values, the algorithm proceeds to 416, otherwise the algorithm proceeds to 420.

At 416, the peak values are removed from the windowed data to generate peak-removed windowed data. In one example embodiment, the peak values can be reduced by a predetermined amount, the peak values can be reduced below a predetermined level, the peak values can be capped to a level that is determined as a function of a minimum sample value or root mean square sample value, or other suitable processes can also or alternatively be used. The algorithm then proceeds to 418.

At 418, energy values for the peak-removed windowed data can be generated. In one example embodiment, the energy values can be determined by performing a fast Fourier Transform and then by multiplying each frequency bin of the output with its complex conjugate, or in other suitable manners. The algorithm then proceeds to 420.

At 420, the energy values generated for the windowed data and the energy values generated for the peak-removed windowed data are processed to generate an encoded high frequency bitstream.

At 426, encoded high frequency bitstream and encoded low frequency bitstream are combined to generate encoded bitstream. In one example embodiment, the encoded high frequency bitstream and encoded low frequency bitstream can be combined by assigning the bit streams to different fields of a packet data structure, can be combined by sequencing the bit streams in a predetermined sequence or can be combined in other suitable manners. The algorithm then proceeds to 428 and terminates.

In operation, algorithm 400 processes an input audio signal to generate an encoded bitstream. Although algorithm 400 is shown in flow chart form, it can also or alternatively be implemented in object-oriented programming, using a ladder diagram, using a state diagram or in other suitable manners.

Figure 5:
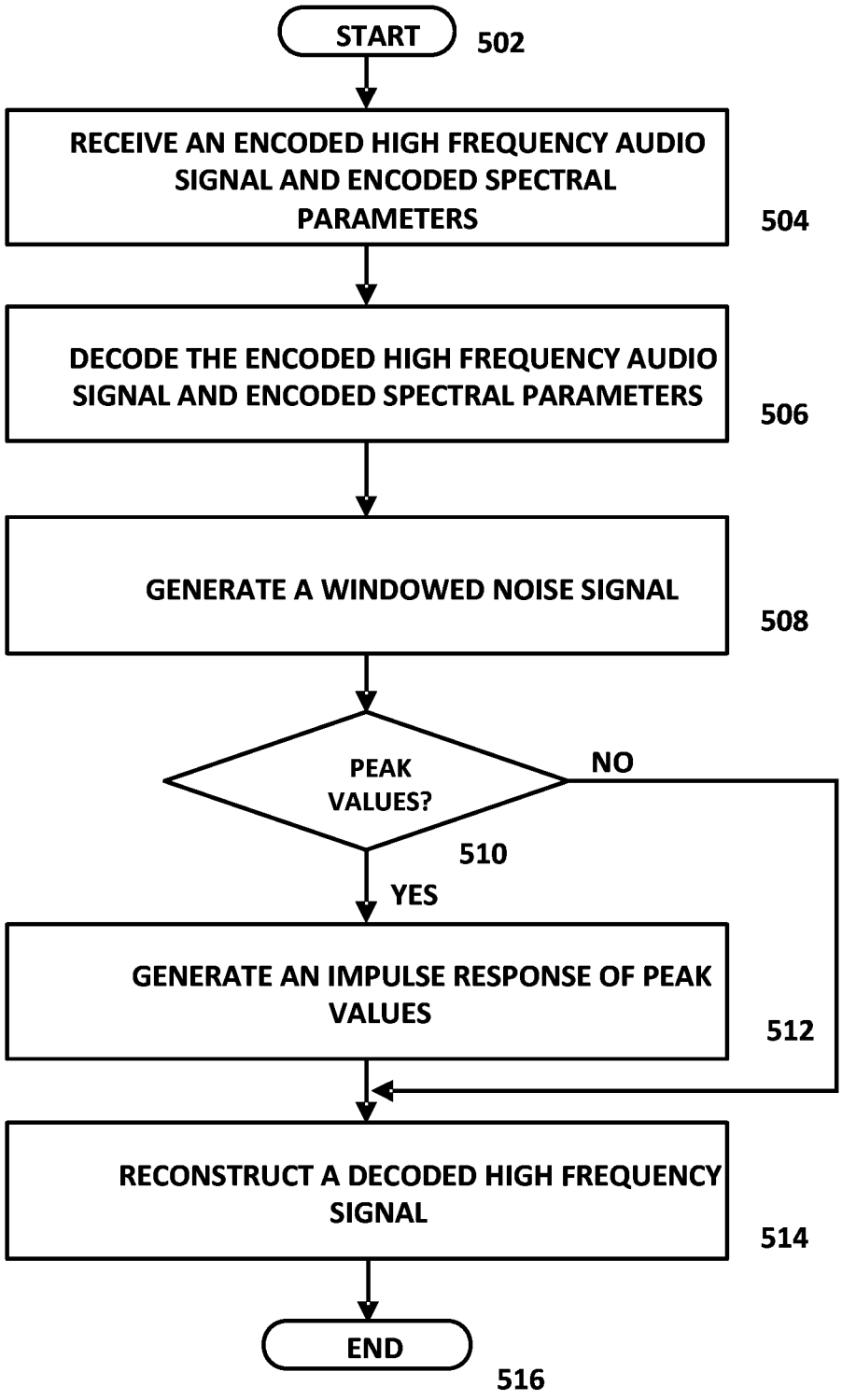
FIG. 5 is an algorithm flow chart depicting a method for decoding an encoded high frequency audio signal, in accordance with an example embodiment of the present disclosure.

FIG. 5 is a diagram of an algorithm 500 for decoding an encoded high frequency audio signal, in accordance with an example embodiment of the present disclosure. Algorithm 500 can be implemented in hardware or a suitable combination of hardware and software, and can be one or more algorithms operating on a processing platform.

Algorithm 500 begins at 502, such as when a device is activated, a decoding application is activated or in other suitable manners. The algorithm then proceeds to 504.

At 504, an encoded high frequency audio signal and encoded spectral parameter of the encoded high frequency audio signal is received. In one example embodiment, the encoded spectral parameters can include quantized LPC coefficients, quantized energy scale values, quantized peak values and other suitable data. The algorithm then proceeds to 506.

At 506, the encoded high frequency audio signal and the encoded spectral parameters are decoded. In one example embodiment, the encoded high frequency audio signal and the encoded spectral parameters can be decoded separately, can be decoded as part of a single decoding process or can be decoded in other suitable manner. The algorithm then proceeds to 508.

At 508, a windowed noise signal is generated. In one example embodiment, the decoded energy scale values can be used to generate the windowed noise signal, or other suitable processes can also or alternatively be used. The algorithm then proceeds to 510.

At 510, it is determined whether peak values are included in the decoded data. In one example embodiment, the decoded data can include peak value data in a predetermined frame location, in a predetermined sequence of bits in a bit stream or in other suitable manner. If it is determined that peak values are not available, the algorithm proceeds to 514, otherwise, the algorithm proceeds to 512.

At 512, an impulse response of the peak values is generated. In one example embodiment, the impulse response can be generated as a function of decoded peak value data or in other suitable manners. The algorithm then proceeds to 514.

At 514, a decoded high frequency signal is reconstructed. In one example embodiment, the impulse response of the peak values can then be added back to the windowed noise signal and used to generate the decoded high frequency signal, or other suitable processes can be used. The algorithm then terminates at 516.

In operation, algorithm 500 processes an encoded bitstream to input audio signal to generate an encoded bitstream. Although algorithm 500 is shown in flow chart form, it can also or alternatively be implemented in object-oriented programming, using a ladder diagram, using a state diagram or in other suitable manners.

Figure 6:
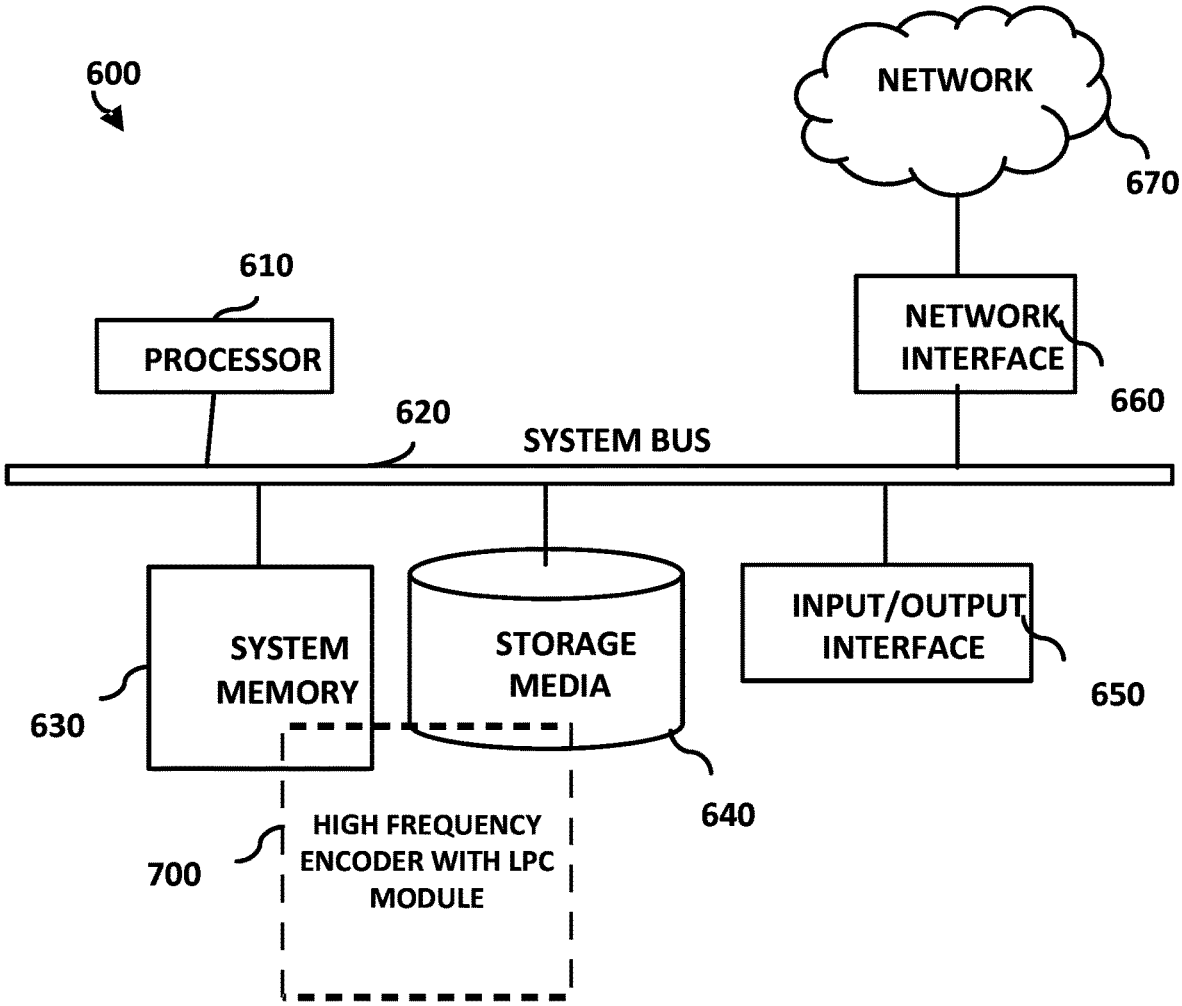
FIG. 6 is a block diagram depicting a computing machine and system applications, in accordance with an example embodiment of the present disclosure.

FIG. 6 is a diagram of a computing machine 600 and a high frequency encoder with LPC module 700 in accordance with example embodiments. The computing machine 600 can correspond to any of the various computers, mobile devices, laptop computers, servers, embedded systems, or computing systems presented herein. The high frequency encoder with LPC module 700 can comprise one or more hardware or software elements designed to facilitate the computing machine 600 in performing the various methods and processing functions presented herein. The computing machine 600 can include various internal or attached components such as a processor 610, system bus 620, system memory 630, storage media 640, input/output interface 650, and a network interface 660 for communicating with a network 670.

The computing machine 600 can be implemented as a conventional computer system, an embedded controller, a laptop, a server, a mobile device, a smartphone, a wearable computer, a customized machine, any other hardware platform, or any combination or multiplicity thereof. The computing machine 600 can be a distributed system configured to function using multiple computing machines interconnected via a data network or bus system.

The processor 610 can be designed to execute code instructions in order to perform the operations and functionality described herein, manage request flow and address mappings, and to perform calculations and generate commands. The processor 610 can be configured to monitor and control the operation of the components in the computing machine 600. The processor 610 can be a general-purpose processor, a processor corer, a multiprocessor, a reconfigurable processor, a microcontroller, a digital signal processor ("DSP"), an application specific integrated circuit ("ASIC"), a controller, a state machine, gated logic, discrete hardware components, any other processing unit, or any combination or multiplicity thereof. The processor 610 can be a single processing unit, multiple processing units, a single processing core, multiple processing cores, special purpose processing cores, co-processors, or any combination thereof. According to certain embodiments, the processor 610 along with other components of the computing machine 600 can be a virtualized computing machine executing within one or more other computing machines.

The system memory 620 can include non-volatile memories such as read-only memory ("ROM"), programmable read-only memory ("PROM"), erasable programmable read-only memory ("EPROM"), flash memory, or any other device capable of storing program instructions or data with or without applied power. The system memory 620 can also include volatile memories such as random access memory ("RAM"), static random access memory ("SRAM"), dynamic random access memory ("DRAM"), and synchronous dynamic random access memory ("SDRAM"). Other types of RAM also can be used to implement the system memory 620. The system memory 630 can be implemented using a single memory module or multiple memory modules. While the system memory 630 is depicted as being part of the computing machine 600, one skilled in the art will recognize that the system memory 630 can be separate from the computing machine 600 without departing from the scope of the subject technology. It should also be appreciated that the system memory 630 can include, or operate in conjunction with, a non-volatile storage device such as the storage media 640.

The storage media 640 can include a hard disk, a floppy disk, a compact disc read-only memory ("CD-ROM"), a digital versatile disc ("DVD"), a Blu-ray disc, a magnetic tape, a flash memory, other non-volatile memory device, a solid state drive ("SSD"), any magnetic storage device, any optical storage device, any electrical storage device, any semiconductor storage device, any physical-based storage device, any other data storage device, or any combination or multiplicity thereof. The storage media 640 can store one or more operating systems, application programs and program modules such as module 2050, data, or any other information. The storage media 640 can be part of, or connected to, the computing machine 600. The storage media 640 can also be part of one or more other computing machines that are in communication with the computing machine 600 such as servers, database servers, cloud storage, network attached storage, and so forth.

The high frequency encoder with LPC module 700 can comprise one or more hardware or software elements configured to facilitate the computing machine 600 with performing the various methods and processing functions presented herein. The high frequency encoder with LPC module 700 can include one or more sequences of instructions stored as software or firmware in association with the system memory 630, the storage media 640, or both. The storage media 640 can therefore represent examples of machine or computer readable media on which instructions or code can be stored for execution by the processor 610. Machine or computer readable media can generally refer to any medium or media used to provide instructions to the processor 610. Such machine or computer readable media associated with the high frequency encoder with LPC module 700 can comprise a computer software product. It should be appreciated that a computer software product comprising the high frequency encoder with LPC module 700 can also be associated with one or more processes or methods for delivering the module 700 to the computing machine 600 via the network 670, any signal-bearing medium, or any other communication or delivery technology. The high frequency encoder with LPC module 700 can also comprise hardware circuits or information for configuring hardware circuits such as microcode or configuration information for an FPGA or other PLD.

The input/output ("I/O") interface 650 can be configured to couple to one or more external devices, to receive data from the one or more external devices, and to send data to the one or more external devices. Such external devices along with the various internal devices can also be known as peripheral devices. The I/O interface 650 can include both electrical and physical connections for coupling the various peripheral devices to the computing machine 600 or the processor 610. The I/O interface 650 can be configured to communicate data, addresses, and control signals between the peripheral devices, the computing machine 600, or the processor 610. The I/O interface 650 can be configured to implement any standard interface, such as small computer system interface ("SCSI"), serial-attached SCSI ("SAS"), fiber channel, peripheral component interconnect ("PCI"), PCI express (PCIe), serial bus, parallel bus, advanced technology attached ("ATA"), serial ATA ("SATA"), universal serial bus ("USB"), Thunderbolt, FireWire, various video buses, and the like. The I/O interface 650 can be configured to implement only one interface or bus technology. Alternatively, the I/O interface 650 can be configured to implement multiple interfaces or bus technologies. The I/O interface 650 can be configured as part of, all of, or to operate in conjunction with, the system bus 620. The I/O interface 650 can include one or more buffers for buffering transmissions between one or more external devices, internal devices, the computing machine 600, or the processor 610.

The I/O interface 650 can couple the computing machine 600 to various input devices including mice, touch-screens, scanners, electronic digitizers, sensors, receivers, touchpads, trackballs, cameras, microphones, keyboards, any other pointing devices, or any combinations thereof. The I/O interface 650 can couple the computing machine 600 to various output devices including video displays, speakers, printers, projectors, tactile feedback devices, automation control, robotic components, actuators, motors, fans, solenoids, valves, pumps, transmitters, signal emitters, lights, and so forth.

The computing machine 600 can operate in a networked environment using logical connections through the network interface 660 to one or more other systems or computing machines across the network 670. The network 670 can include wide area networks (WAN), local area networks (LAN), intranets, the Internet, wireless access networks, wired networks, mobile networks, telephone networks, optical networks, or combinations thereof. The network 670 can be packet switched, circuit switched, of any topology, and can use any communication protocol. Communication links within the network 670 can involve various digital or an analog communication media such as fiber optic cables, free-space optics, waveguides, electrical conductors, wireless links, antennas, radio-frequency communications, and so forth.

The processor 610 can be connected to the other elements of the computing machine 600 or the various peripherals discussed herein through the system bus 620. It should be appreciated that the system bus 620 can be within the processor 610, outside the processor 610, or both. According to some embodiments, any of the processor 610, the other elements of the computing machine 600, or the various peripherals discussed herein can be integrated into a single device such as a system on chip ("SOC"), system on package ("SOP"), or ASIC device.

The present disclosure includes numerous example embodiment. In one example embodiment, a method for encoding an audio signal with an original sampling rate is disclosed. The method includes filtering the audio signal into two output signals with sampling rates equal to the original sampling rate, wherein one of the output signals includes high frequency data. The high frequency data is windowed, and a set of LPC coefficients is determined for the windowed data. Energy values are generated for the windowed data, and an encoded high frequency bitstream is then generated using the energy values.

In another example embodiment, the method can further include detecting position and amplitude of peak values from the windowed data using the determined LPC coefficients. The peak values from the windowed data are then removed, and energy values for the remaining data are generated. The position and amplitude of the peak values, the determined coefficients, and the energy values are then encoded.

In another example embodiment, a method for decoding an encoded high frequency audio signal is disclosed, wherein the high frequency audio signal includes encoded spectral parameters. The method includes decoding the encoded high frequency audio signal and the encoded spectral parameters, wherein the decoded parameters include LPC coefficients and energy scale values. A windowed noise signal corresponding to the energy scale values is then generated. A decoded high frequency signal is reconstructed from the windowed noise signal using the LPC coefficients.

In another example embodiment, the decoded parameters include peak values, and the method further includes generating impulse response of the peak values, and adding the impulse response to the windowed noise signal.

As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items. As used herein, phrases such as "between X and Y" and "between about X and Y" should be interpreted to include X and Y. As used herein, phrases such as "between about X and Y" mean "between about X and about Y." As used herein, phrases such as "from about X to Y" mean "from about X to about Y."

As used herein, "hardware" can include a combination of discrete components, an integrated circuit, an application-specific integrated circuit, a field programmable gate array, or other suitable hardware. As used herein, "software" can include one or more objects, agents, threads, lines of code, subroutines, separate software applications, two or more lines of code or other suitable software structures operating in two or more software applications, on one or more processors (where a processor includes one or more microcomputers or other suitable data processing units, memory devices, input-output devices, displays, data input devices such as a keyboard or a mouse, peripherals such as printers and speakers, associated drivers, control cards, power sources, network devices, docking station devices, or other suitable devices operating under control of software systems in conjunction with the processor or other devices), or other suitable software structures. In one exemplary embodiment, software can include one or more lines of code or other suitable software structures operating in a general purpose software application, such as an operating system, and one or more lines of code or other suitable software structures operating in a specific purpose software application. As used herein, the term "couple" and its cognate terms, such as "couples" and "coupled," can include a physical connection (such as a copper conductor), a virtual connection (such as through randomly assigned memory locations of a data memory device), a logical connection (such as through logical gates of a semiconducting device), other suitable connections, or a suitable combination of such connections. The term "data" can refer to a suitable structure for using, conveying or storing data, such as a data field, a data buffer, a data message having the data value and sender/receiver address data, a control message having the data value and one or more operators that cause the receiving system or component to perform a function using the data, or other suitable hardware or software components for the electronic processing of data.

In general, a software system is a system that operates on a processor to perform predetermined functions in response to predetermined data fields. A software system is typically created as an algorithmic source code by a human programmer, and the source code algorithm is then compiled into a machine language algorithm with the source code algorithm functions, and linked to the specific input/output devices, dynamic link libraries and other specific hardware and software components of a processor, which converts the processor from a general purpose processor into a specific purpose processor. This well-known process for implementing an algorithm using a processor should require no explanation for one of even rudimentary skill in the art. For example, a system can be defined by the function it performs and the data fields that it performs the function on. As used herein, a NAME system, where NAME is typically the name of the general function that is performed by the system, refers to a software system that is configured to operate on a processor and to perform the disclosed function on the disclosed data fields. A system can receive one or more data inputs, such as data fields, user-entered data, control data in response to a user prompt or other suitable data, and can determine an action to take based on an algorithm, such as to proceed to a next algorithmic step if data is received, to repeat a prompt if data is not received, to perform a mathematical operation on two data fields, to sort or display data fields or to perform other suitable well-known algorithmic functions. Unless a specific algorithm is disclosed, then any suitable algorithm that would be known to one of skill in the art for performing the function using the associated data fields is contemplated as falling within the scope of the disclosure. For example, a message system that generates a message that includes a sender address field, a recipient address field and a message field would encompass software operating on a processor that can obtain the sender address field, recipient address field and message field from a suitable system or device of the processor, such as a buffer device or buffer system, can assemble the sender address field, recipient address field and message field into a suitable electronic message format (such as an electronic mail message, a TCP/IP message or any other suitable message format that has a sender address field, a recipient address field and message field), and can transmit the electronic message using electronic messaging systems and devices of the processor over a communications medium, such as a network. One of ordinary skill in the art would be able to provide the specific coding for a specific application based on the foregoing disclosure, which is intended to set forth exemplary embodiments of the present disclosure, and not to provide a tutorial for someone having less than ordinary skill in the art, such as someone who is unfamiliar with programming or processors in a suitable programming language. A specific algorithm for performing a function can be provided in a flow chart form or in other suitable formats, where the data fields and associated functions can be set forth in an exemplary order of operations, where the order can be rearranged as suitable and is not intended to be limiting unless explicitly stated to be limiting.

It should be emphasized that the above-described embodiments are merely examples of possible implementations. Many variations and modifications may be made to the above-described embodiments without departing from the principles of the present disclosure. All such modifications and variations are intended to be included herein within the scope of this disclosure and protected by the following claims.

What is claimed is:

1. A method for encoding an audio signal, comprising:

using one or more algorithms operating on a processor to filter an input audio signal into two output signals, wherein each output signal has a sampling rate that is equal to a sampling rate of the input audio signal, and wherein one of the output signals includes high frequency data;

using one or more algorithms operating on the processor to window the high frequency data by selecting a set of the high frequency data and windowing the selected high frequency data in time domain;

using one or more algorithms operating on the processor to determine a set of linear predictive coding (LPC) coefficients for the windowed data;

using one or more algorithms operating on the processor to generate energy scale values for the windowed data; and using one or more algorithms operating on the processor to generate an encoded high frequency bitstream.

2. The method of claim 1, further comprising using one or more algorithms operating on the processor to detect a position and an amplitude for each of a plurality of peak values from the windowed data using the determined LPC coefficients.

3. The method of claim 2, further comprising using one or more algorithms operating on the processor to remove the peak values from the windowed data to generate peak-removed windowed data.

4. The method of claim 3, further comprising using one or more algorithms operating on the processor to generate energy scale values for the peak-removed windowed data.

5. The method of claim 4, further comprising using one or more algorithms operating on the processor to encode the position and the amplitude for each of the peak values, the determined LPC coefficients, and the energy scale values.

6. The method of claim 1 wherein the energy scale values are generated by performing a fast Fourier Transform on the windowed data to generate an output and then by multiplying each frequency bin of the output with its complex conjugate.

7. The method of claim 3 wherein the energy scale values are generated by performing a fast Fourier Transform on the peak-removed windowed data to generate an output and then by multiplying each frequency bin of the output with its complex conjugate.

8. An apparatus for encoding an audio signal, comprising:

a computer-usable non-transitory storage resource, and a processor communicatively coupled to the storage resource, wherein the processor is configured to:

filter an input audio signal into two output signals, wherein each output signal has a sampling rate that is equal to a sampling rate of the input audio signal, and wherein one of the output signals includes high frequency data;

window the high frequency data by selecting a set of the high frequency data and windowing the selected high frequency data in time domain;

determine a set of linear predictive coding (LPC) coefficients for the windowed data;

generate energy scale values for the windowed data; and generate an encoded high frequency bitstream.

9. The apparatus of claim 8, wherein the processor is further configured to detect a position and an amplitude for each of a plurality of peak values from the windowed data using the determined LPC coefficients.

10. The apparatus of claim 9, wherein the processor is further configured to remove the peak values from the windowed data to generate peak-removed windowed data.

11. The apparatus of claim 10, wherein the processor is further configured to generate energy scale values for the peak-removed windowed data.

12. The apparatus of claim 11, wherein the processor is further configured to encode the position and the amplitude for each of the peak values, the determined LPC coefficients, and the energy scale values.

13. A method for encoding an audio signal, comprising:

using one or more algorithms operating on a processor to filter an input audio signal into two output signals, wherein each output signal has a sampling rate that is equal to a sampling rate of the input audio signal, and wherein one of the output signals includes high frequency data;

using one or more algorithms operating on the processor to window the high frequency data by selecting a set of the high frequency data and windowing the selected high frequency data in time domain;

using one or more algorithms operating on the processor to determine a set of linear predictive coding (LPC) coefficients for the windowed data;

using one or more algorithms operating on the processor to generate energy scale values for the windowed data;

using one or more algorithms operating on the processor to detect a position and an amplitude for each of a plurality of peak values from the windowed data using the determined LPC coefficients; and using one or more algorithms operating on the processor to generate an encoded high frequency bitstream, wherein the energy scale values are generated by performing a fast Fourier Transform on the windowed data to generate an output and then by multiplying each frequency bin of the output with its complex conjugate.

14. The method of claim 13, further comprising using one or more algorithms operating on the processor to remove the peak values from the windowed data to generate peak-removed windowed data.

15. The method of claim 14, further comprising using one or more algorithms operating on the processor to generate energy scale values for the peak-removed windowed data.

16. The method of claim 15, further comprising using one or more algorithms operating on the processor to encode the position and the amplitude for each of the peak values, the determined LPC coefficients, and the energy scale values.

17. The method of claim 14 wherein the energy scale values are generated by performing a fast Fourier Transform on the peak-removed windowed data to generate an output and then by multiplying each frequency bin of the output with its complex conjugate.

* * * * *